US009353602B2

(12) United States Patent
Kongshem

(10) Patent No.: US 9,353,602 B2
(45) Date of Patent: May 31, 2016

(54) RISER WEAK LINK

(75) Inventor: Christian Andreas Kongshem, Rauland (NO)

(73) Assignee: STATOIL PETROLEUM AS, Stavanger (NO)

( * ) Notice: Subject to any disclaimer, the term of this patent is extended or adjusted under 35 U.S.C. 154(b) by 42 days.

(21) Appl. No.: 14/359,066

(22) PCT Filed: Nov. 18, 2011

(86) PCT No.: PCT/EP2011/070491
§ 371 (c)(1),
(2), (4) Date: Jul. 1, 2014

(87) PCT Pub. No.: WO2013/071983
PCT Pub. Date: May 23, 2013

(65) Prior Publication Data

US 2014/0311749 A1 Oct. 23, 2014

(51) Int. Cl.
*E21B 7/12* (2006.01)
*E21B 41/00* (2006.01)
*E21B 17/01* (2006.01)

(52) U.S. Cl.
CPC ..... *E21B 41/0007* (2013.01); *E21B 17/01* (2013.01)

(58) Field of Classification Search
CPC ..... E21B 17/01; E21B 17/06; E21B 17/085
USPC ..... 166/340, 364, 365, 367
See application file for complete search history.

(56) References Cited

U.S. PATENT DOCUMENTS

| | | | | |
|---|---|---|---|---|
| 4,059,288 | A | 11/1977 | Mohr | |
| 4,424,988 | A | 1/1984 | Cowx | |
| 4,880,257 | A * | 11/1989 | Holbert, Jr. | 285/2 |
| 5,382,056 | A | 1/1995 | Milberger | |
| 7,100,696 | B2 * | 9/2006 | Marshall | 166/377 |
| 8,555,981 | B2 * | 10/2013 | Edwards et al. | 166/365 |
| 8,727,014 | B2 * | 5/2014 | Edwards | 166/350 |
| 9,022,127 | B2 * | 5/2015 | Muff et al. | 166/367 |
| 9,038,731 | B2 * | 5/2015 | Edwards | 166/350 |
| 9,091,127 | B2 * | 7/2015 | Olsen | |
| 2002/0009336 | A1 | 1/2002 | Munk et al. | |
| 2008/0311804 | A1 | 12/2008 | Bauduin et al. | |
| 2009/0304454 | A1 * | 12/2009 | Edwards | 405/224.4 |
| 2014/0034329 | A1 * | 2/2014 | Skinnes et al. | 166/355 |

FOREIGN PATENT DOCUMENTS

| | | | |
|---|---|---|---|
| CN | 201367863 | Y | 12/2009 |
| CN | 101730784 | A | 6/2010 |

(Continued)

*Primary Examiner* — Matthew R Buck
*Assistant Examiner* — Aaron Lembo
(74) *Attorney, Agent, or Firm* — Birch, Stewart, Kolasch & Birch, LLP

(57) ABSTRACT

A riser weak link in a riser connects a floating installation or vessel to a hydrocarbon well on the seabed. The weak link includes a first riser part in the form of an upper housing for connecting to a riser upper section; a second riser part in the form of a lower housing for connecting to a riser lower section, wherein one riser part is arranged to extend into the other riser part; and connection devices for releasably connecting the upper and lower housings. The weak link includes a first connection device arranged to fail if a tensile force on the first and second riser parts exceeds a first threshold force, and that the weak link includes a second connection device arranged to fail if a compressive force on the first and second riser parts exceeds a second threshold force.

12 Claims, 7 Drawing Sheets

(56) References Cited

FOREIGN PATENT DOCUMENTS

| | | | |
|---|---|---|---|
| CN | 102168536 | A | 8/2011 |
| WO | WO 03/069112 | A1 | 8/2003 |
| WO | WO 2008/003974 | A2 | 1/2008 |
| WO | WO 2009/153567 | A1 | 12/2009 |
| WO | WO 2010/090531 | A1 | 8/2010 |

* cited by examiner

RISER WEAK LINK

TECHNICAL FIELD

The present invention relates to a riser weak link in a riser connecting a floating installation or vessel to a hydrocarbon well on the seabed.

BACKGROUND ART

Risers are commonly used to link hydrocarbon wells on the seabed to floating installations or vessels such as oil rigs or ships. A riser is made up of lengths of tubing and is extremely heavy. The surface vessel therefore needs to apply tension to the riser to prevent it collapsing under its own weight. However, in certain sea conditions, for example, as the vessel moves, the applied tension will fluctuate. As the riser is fixed at its lower end to the wellhead assembly on the seabed and at its upper end, by the tensioners, to a floating installation or vessel, it is necessary for motion of the installation caused by wind, wave and tidal action to be accommodated. Consequently, motion compensating means must be incorporated into the tensioning system to maintain the top of the riser within the moon pool of a ship and at rig floor level. This may include a telescopic marine joint or a drill string compensator to compensate for heaving motion while maintaining a predetermined tension to the riser and a flex joint within the riser to compensate for lateral motion of the vessel. The telescopic marine joints used are well known and are referred to herein as slip joints. A typical slip joint comprises concentric cylinders which are arranged to telescope relative to each other, with a dynamic seal provided between them.

However, should the motion compensating means lock up, the tension in the riser will fluctuate. At excessive tensions, it is known for risers to break. This can cause an environmental problem as the riser may be full of hydrocarbons at the time of separation, which hydrocarbons could subsequently leak from the riser.

To counter this problem, risers may be provided with a weak link which has a lower tensile rating than the other components of the riser and, in the event of over tensioning the riser, the riser will separate at the weak link.

WO 03/069112 discloses a sleeve, which is positioned around a riser. The sleeve can move up and down the riser between two raised portions. The sleeve can be attached to blow out preventer rams such that the riser can rotate or move in an axial direction with respect to the blow out preventer. The sleeve is initially fixed to the riser with shear pin, which may fail after attaching the sleeve to a blow out preventer ram.

U.S. Pat. No. 4,424,988 discloses a weak link formed by a weakened portion of a bolt connecting two riser portions. The document discloses two ways of breaking the bolt: first, by a tensile force between the upper and lower riser section; second, by applying a high hydraulic pressure to a chamber within a connector between the two riser portions. The hydraulic pressure within the chamber causes a pressure differential between an annular member and an annular flange, which causes the bolt to fail when a threshold pressure is exceeded. The two riser portions can move with respect to each other after the bolt has failed.

WO 2009/153567 discloses a weak link. Within the weak link, the effects of a variable well pressure are balanced by the application of hydraulic pressure. A pressure application device is provided to apply a coupling force to the weak link in order to counter a separation force applied by well pressure. Separation of the weak link due to well pressure can thereby be avoided.

A problem with the above weak link solutions is that they only provide protection against tensile forces between the upper and lower riser section. Should the motion compensating means lock up during an initial downward motion of a floating installation or vessel, the known solutions offer no protection against compression forces to the riser.

The object of the invention is therefore to provide an improved solution that solves the above problems relating to motion caused by compressive as well as tensile forces and is more reliable in terms of functionality. These objects and others will become apparent from the following description.

DISCLOSURE OF INVENTION

The above problems are solved by a weak link and a riser string provided with such a weak link according to the appended claims.

In the subsequent text, a riser string is defined as an arrangement extending from a floating installation or vessel to a hydrocarbon well on the seabed. Said riser string comprises a motion compensating means, which is part of an upper landing string located on the floating installation, multiple riser pipe sections supported by the motion compensating means, and a lower landing string located on the seabed. The lower landing string can comprise multiple component, such as a casing string cross-over (X/O), an annular slick Joint, a spacer spool, a retainer valve, a shearable sub a sub sea test tree, a pipe ram slick joint, a spacer spool, a tubing hanger running and a tool adaptor. Such components are well known to the skilled person and will not be described in further detail.

In the subsequent text, a riser is defined as a portion of the riser string excluding the motion compensating means. A lower section of the riser and the sub sea test tree (SSTT) are connected by a weak link arranged to separate when the riser is subjected to excessive force.

The present invention relates to a riser weak link in a riser connecting a floating installation or vessel to a hydrocarbon well on the seabed. The weak link comprises a first riser part, which is the upper portion of the weak link. The first riser part can be in the form of an upper housing for connecting to a riser upper section. The riser upper section extends from the weak link to the floating installation or vessel on the surface. The weak link further comprises a second riser part, which is the lower portion of the weak link. The second riser part can be in the form of a lower housing for connecting to a riser lower section. The riser lower section extends from the weak link to the seabed and comprises a sub sea test tree (SSTT). The first riser part is arranged to extend into the second riser part, in order to allow for a telescoping displacement between the riser parts under predetermined conditions. A number of connection devices are provided for releasably connecting the upper and lower housings.

The weak link comprises a first connection device arranged to fail if a tensile force on the first and second riser parts exceeds a first threshold force. The weak link further comprises a second connection device arranged to fail if a compressive force on the first and second riser parts exceeds a second threshold force.

According to the invention, the first threshold force is larger than the second threshold force. The relationship between the first and second threshold forces is dependent on the type of installation, the length of the riser, etc. Merely as an example, the first threshold force can be selected to release the weak link at a load of 250 metric tonnes in tension, while the second threshold force can be selected to release the weak link at a load of 35 metric tonnes in compression. The weak link is provided in the sub sea riser to limit damage, e.g. to a platform, or to installations on the seabed, e.g. to a SSTT, in the event of failure of the riser or a motion compensation device on the surface. The invention aims to improve on the known weak link designs by providing a weak link that is able to withstand a tensile force that is greater than the compression force that a riser can withstand. The arrangement according to the invention provides an asymmetry between compressive forces and tensile forces acting on the riser and the weak link.

After separation the first and second riser parts are arranged to telescope with respect to each other, wherein the first and second riser parts are arranged to telescope in a first direction following the failure of said first connection device, and/or to telescope in a second direction following the failure of said second connection device. The direction is dependent on which connection device fails first. The first and second riser parts are arranged to telescope with respect to each other up to a maximum predetermined distance in the first or the second direction, from an initial datum or mid-point position. The total distance between the upper and the lower end points of the telescoping motion is termed the stroke of the weak link. The maximum predetermined distance is substantially equal in both directions and is dependent on the allowable motion of a motion compensation means on the floating installation or vessel. The allowable motion of a motion compensation means is dependent on the expected motion, or heave of the floating installation or vessel. Merely as an example, if the allowable motion of a motion compensation means is approximately 4.5-5 meters up and down, the maximum predetermined distance can be 4 meters in each direction. If the heave of the floating installation or vessel exceeds a maximum allowable stroke prior to separation of the weak link, then the weak link is disconnected from the sub sea test tree to avoid damage to the sub sea structure. Also, if the maximum predetermined distance is exceeded before the weak link will can be disconnected, then either or both of the first and second connection devices will fail and release the weak link.

The first connection device can comprise tension bolts or similar suitable means. The first and second riser part can be connected by at least two tension bolts arranged to break in tension when the first threshold force is exceeded. Separation of the first and second riser parts caused by tensile forces on the tension bolts will simultaneously cause the shear pins to break. Said first connection device is preferably, but not necessarily, located in an annular section surrounding the riser and extends through a plane at right angles to the main extension of the riser. This plane separates the first and second riser parts and is also where the first and second riser parts will separate if the first threshold force is exceeded.

The tension bolts are pre-tensioned in order to improve the control of dynamic fatigue. The riser is held in top tension over a longer period, possibly between 2 and 4 weeks at the time. As the riser is supported by the motion compensating device, the weak link is subjected to a compensator load caused by friction in the motion compensating device. Depending on the heave of the surface installation, the riser and the weak link can be subjected to a dynamic load varying between 45 and 55 tonnes. The tension bolts are subjected to this dynamic load continuously.

The second connection device can comprise shear pins or similar suitable means. The first and second riser part can be connected by at least two shear pins or a similar suitable device arranged to break in shear when the second threshold force is exceeded. Said second connection device is arranged in a radial plane through the riser to connect the first and second riser parts and will shear if the second threshold force is exceeded. The second connection device is axially remote from the first connection device along the main axis of the weak link.

As opposed to the tension bolts, the shear pins are not subjected to dynamic loads over a longer period of time. The shear pins are preloaded with a predetermined load in order to allow them to withstand a certain amount of compressive force without shearing. For example, the shear pins can be designed to shear at a compressive load of 35 tonnes. However, the shear pins can be preloaded by e.g. 10 tonnes in the opposite direction. Consequently, when the weak link is subjected to a compressive load in excess of 45 tonnes, the shear pins will shear (45 t−10 t=35 t). The reason for such a pre tension is to allow short term loading of the weak link without causing the connection devices to shear. For instance, when a tuber hanger running tool is lowered in order to latch a riser and a weak link onto a sub sea test tree, then the weak link must be able to withstand a predetermined compressive load. This compressive load only occurs over a short period and the shear pins are not subjected to dynamic fatigue over a longer period. Hence this arrangement gives an improved control of the shear pin loading.

Alternatively, the riser weak link comprises an override mechanism provided to ensure that the upper and lower housings do not separate, for example, when the riser weak link is being run into position. Such an override mechanism could be used instead of or together with preloaded shear pins.

An upper sealing means in the form of a valve is located in the first riser part and is arranged to close the riser upper section. The valve is actuated after separation of the first connection device, when the first threshold force is exceeded and the first riser part telescopes upwards, away from the second riser part. Should the second threshold force be exceeded first, so that the first riser part telescopes downwards, into the second riser part, then closure of the valve is not actuated. Closure of the valve prevents hydrocarbons from flowing downwards and out of the riser upper section into the surrounding sea or a marine riser.

A marine riser extends from the sea floor to the surface platform above. The marine riser is designed to house the drill bit and drill string or a production tube, and yet be flexible enough to deal with the movement of the surface platform. Strategically placed slip and ball joints in the marine riser allow the sub sea well to be unaffected by the pitching and rolling of the platform.

The valve is actuated by an actuator displaced by the relative motion of the first and second riser parts, as the riser and the first riser part is lifted upwards. The valve is preferably, but not necessarily, a ball valve with a spherical valve body. Alternatively, the closure device may be a mechanically controllable flapper valve, gate valve or ram.

A ram is the closing and sealing valve component commonly used in e.g. a blow-out preventer. There are three types of rams; a blind ram, a pipe ram, or a shear ram. In a sub sea test tree such ram can be installed in several preventers mounted in a stack on top of the well bore. Blind rams, when closed, form a seal on a hole that has no drill pipe in it. Pipe rams, when closed, seal around the pipe. Shear rams can cut through a drill pipe and then form a seal.

The valve is provided with a valve actuator which can comprise a lever, a control arm or a similar device connected to the valve body. The control arm can be connected to the valve body by means of a suitable one-way mechanism such as a one-way clutch, a one-way ratchet or similar. Such a mechanism ensures that the valve body is actuated to close the valve only after separation of the first connection device, when the first threshold force has been exceeded. The other end of the control arm is connected to the second riser part via a control rod. The control rod has a predetermined initial length and is connected to the control arm at its first end and is supported by and attached to the second riser part at its other. The control rod is arranged to compress in its longitudinal direction if the second threshold force be exceeded first, whereby that the first riser part telescopes downwards into the second riser part. This can be achieved by forming a first portion of the control rod out of a hollow profiled section or a tubular section. A second portion of the control rod can comprise a solid or hollow section having a cross-section that can be telescoped into said first portion. As the first and second portions of the control rod telescope in the longitudinal direction, the ball valve is not actuated after separation of the shear pins.

However, should the first threshold force be exceeded first, the control rod will not extend from its predetermined initial length. Instead the control rod will act on the control arm as the first and second riser parts telescope away from each other. If the control arm is arranged to actuate a ball valve, then the valve body will be rotated through 90° to close the valve. Once the valve has been closed, further action applied to the control arm will cause the connection between the control arm and the valve body to become inoperative. This can be achieved by a weakened section of the control arm, which will break when subjected to a predetermined load, by a shear pin in the connection between the control arm and the valve body, by a mechanical disconnection of the connection between the control arm and the valve body when the rotation exceeds 90°, or by a similar suitable releasing means.

When actuated, the ball valve will close and at the same time physically cut and seal off equipment such as a wire line or coiled tubing above the separation point. A wire line is a slender, rod like or threadlike piece of metal usually small in diameter, that is used for lowering special tools (such as logging probes, perforating guns, and similar) into the well. A wire line is also referred to as a slick line. Coiled tubing is a continuous string of flexible steel tubing, often several hundred meters long, which is wound onto a reel, often several meters in diameter. The reel is an integral part of the coiled tubing unit, which consists of several devices that ensure the tubing can be safely and efficiently inserted into the well from the surface. Coiled tubing is also referred to as reeled tubing. Coil tubing is used for performing operations down-hole in the well, e.g. drilling holes to allow a flow meter to measure flow in different zones in the well to determine the production rate from said zone. Examples of such tools are production logging tools (PLTs). Production logging tools are used routinely on producing hydrocarbon wells to determine the source of oil, gas and water production, where the well has perforations in more than one layer, or over a large interval. Typically, the PLT tool string will be composed of one or more spinner flow meters, a pressure gauge, a temperature gauge, and a fluid density or capacitance tool.

Coiled tubing is transported using a coiled-tubing unit, which comprises a reel for the coiled tubing, an injector head to push the tubing down the well, a wellhead blow-out preventer stack, a power source (usually a diesel engine and hydraulic pumps), and a control console. A unique feature of the unit is that it allows continuous circulation while it is being lowered into the hole. A coiled tubing unit is usually mounted on a trailer or skid. A coiled-tubing workover is a workover performed with a continuous steel tube, normally 0.75 inch to 1 inch (1.9 to 2.54 centimeters) outside diameter, which is run into the well in one piece inside the normal tubing. Lengths of the tubing (up to 5000 meters) are stored on the surface on a reel in a manner similar to that used for wire line. The unit is rigged up over the wellhead. The tubing is injected through a control head that seals off the tubing and makes a pressure-tight connection.

In order to maintain control of the lower landing string, the riser weak link system (RWLS) according to the invention can have at least 20 hydraulic service lines to the lower landing string.

The RWLS service lines shall not have a lower flow capability than the umbilical line used during normal operation. The RWLS shall have a minimum of 4 operative hydraulic lines to serve the lower landing string after shear off following separation of the weak link. The RWLS shall have minimum of 1 chemical injection line lower landing string.

In case of weak link separation, the RWLS shall

- vent open hydraulic service lines to upper and lower ball valves. The emergency separation device (ESD) sequence shall cover requirements on predetermined desired valve closing time
- trap and retain hydraulic pressure on tubing hanger running tool (THRT) lines on shear off
- have a system that triggers an emergency separation device (ESD) when the RWLS separates, wherein one of the 4 lines is dedicated to assist close pressure to a SSTT dedicated ball valve; and
- have a recovery system that can pick up the sheared RWLS when picking up the completion/workover riser (C/WOR), i.e. the riser and RWLS.

A lower ball valve is located in upper portion of the SSTT fixed to the seabed, which in turn is located below the lower portion of the weak link that is screwed into the SSTT. The lower ball valve in the SSTT will close a predetermined period of time after the upper ball valve in the weak link to eliminate the end cap pressure and to prevent additional HC from leaking out of the well. The reason for the delay in closing is that the upper ball valve is actuated mechanically, without a delay, while the lower ball valve in the SSTT is actuated hydraulically and may have a reaction time of up to, for instance, 30 s. As stated above, a sub sea test tree can be provided with multiple rams installed in several preventers mounted in a stack on top of the well bore. Blind rams will form a seal on a hole that has no drill pipe in it, pipe rams will seal around the pipe, and shear rams will cut through a drill pipe and form a seal.

According to one example, the SSTT can be provided with at least two valves, which are hydraulically controlled from the surface via control lines. In addition, a fail-safe function is built into the system in case of a weak link separation. The weak link provides by-pass hydraulic lines for closing the lower ball valve. The SSTT valve can close with sufficient force to cut control lines (wire lines) extending into the well.

After release, the hydraulic control lines for maintaining communication with the SSTT, in particular with the SSTT latch, must be able to extend to compensate for the stroke of the weak link from the datum line to maximum extension. The hydraulic control lines can comprise a folded or coiled bundle of lines which bundle is arranged to extend and to be controllably folded or coiled to its original position with the motion of the weak link parts. The hydraulic control lines remain in operation even after the SSTT closes after a fail safe operation. The control lines can also be used for release of the SSTT latch to disconnect the riser for pull-up and weak link repair.

When the upper ball valve closes, hydrocarbons (HC) is prevented from flowing down through the riser after separation to cause an HC spill. Closing of the upper ball valve causes a jetting effect on the weak link often referred to as end cap pressure. This pressure is caused by HC under pressure flowing from the well and will act upwards on the weak link and the riser, which could result in a loss of top tension. For instance, with a well pressure of 690 bar and with standard sizes of riser and ball valve diameters, the HC can act on the riser with an end cap pressure of 170 tonnes. As the surface tree and the riser may have a combined weight of 40-50 tonnes, the end cap pressure could lift the entire assembly if not controlled. HC under pressure will be ventilated from the weak link before maximum upwards stroke is reached, until the lower ball valve in the SSTT closes.

In order to release the end cap pressure after separation but before the lower ball valve closure, and to ensure that any remaining enclosed pressure is vented before the upper weak link portion reaches its maximum extension upwards and begins to move downwards, a pressure release means is actuated. The first riser part of the upper portion of the weak link extends down into the second riser part of the lower portion of the weak link. A portion of the first riser part extending into the second riser part is surrounded by a static packing, such as a liner or a split bearing, extending over a major portion of said part. As will be described in further detail below, the axial length of the static packing can be substantially the same as the maximum distance between the upper end point of the telescoping motion and the initial datum or mid-point position. The split bearing is held in position by said part and is arranged to be displaced upwards with the upper part of the weak link upon separation of the tension bolts. Displacement of the split bearing will expose a number of radial vent holes through the wall of the lower weak link part. According to one example, holes of gradually increasing diameter will be exposed in sequence over the length of the stroke as the split bearing moves upwards. Initial, relatively smaller holes will begin to release the relatively high enclosed pressure at a rate that will not damage or burst a surrounding marine riser. Continued upwards motion will cause gradual, controlled release of pressurized HC into the marine riser. The size and/or number of holes is determined by a number of factors, such as the well pressure, ambient pressure (depth below sea level), etc. In applications where a marine riser is not used, the rate of pressure release can be higher.

The lower end of the tubular section is provided with an additional pressure release means, which is actuated when the second connection device has sheared. The additional pressure release means is used for venting pressure from a cavity formed by the upper and lower housings in the weak link after closure of at least the upper ball valve. As stated above, the tubular section of the upper housing is arranged to telescope downwards, into said cavity in the lower housing, following the failure of said shear pins. The pressure in the cavity is initially vented through the radial vent holes, as the lower end of the tubular section moves downwards. Once the leading end of said lower end of the tubular section passes the lowermost of the radial holes, the additional pressure release means maintains the venting function.

A retaining device is arranged to suspend the second riser part below the first riser part following the release of the first and second connection devices. The retaining device can comprise two or more rods attached to the first riser part at a suitable location thereof. The second riser part is arranged to be displaceable relative to the retaining device during the telescoping movement following a separation of the weak link.

Following a release of the first and second connection devices the first and second riser parts are allowed to telescope relative to each other without being impeded by the retaining device, which will allow for movement in excess of the stroke of the weak link. After a separation of the weak link, a controlled unlatching of the weak link from the SSTT is initiated. Once the weak link is unlatched, the second riser part will be caught and supported by the retaining device. The riser and the first and second riser parts can then be brought to the surface for repairs.

Should the riser be subjected to excessive tension after a separation, but before the weak link has been unlatched from the SSTT, the retaining device will break and release the second riser part. The riser and the first riser part can then be salvaged. The force required to break the retaining device is preferably larger than the first threshold force.

General design requirements for a weak link according to the invention can include the following non-limiting features;

- The design shall ensure that component design (weak mode) is not exposed to compressive dynamic loads to prevent dynamic exhaust to the primary shear elements;
- The minimum design temperature range shall be temperature class U, that is, −18° C. to +121° C.;
- The flange pressure rating should be 10K (JIS standard);
- The design allows for changing of the load capacity of shear pins in order to adapt them for different applications;
- The system shall have same rating as a standard riser joint;
- Shear elements shall be replaceable for different specifications;
- The design shall have a maximum outer diameter of 18½";
- The maximum longitudinal extension is approximately 15 meters;
- The design shall take a minimum torsion of 30 000 ft/lbs;
- The torsion value after break shall cover 10 000 ft/lbs;
- Maximum rotation after break is limited so that hydraulic lines are not damaged during maximum rotation and maximum stroke out/in;
- The design shall prevent hydraulic lines from being damaged after break and shall handle a stroke period of 8-12 s at maximum stroke 4.5 meters for 24 hours;
- The design provides a RWLS having no loose objects that can fall into the marine riser or damage the RWLS in compensating mode after break;
- The RWLS shall have a system that will dampen shear off energy, by venting excess pressure;
- The design shall secure all breakable objects to allow identification and analysis on the surface after a break incident;
- The recovery system shall be able to carry 100 metric tonnes.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
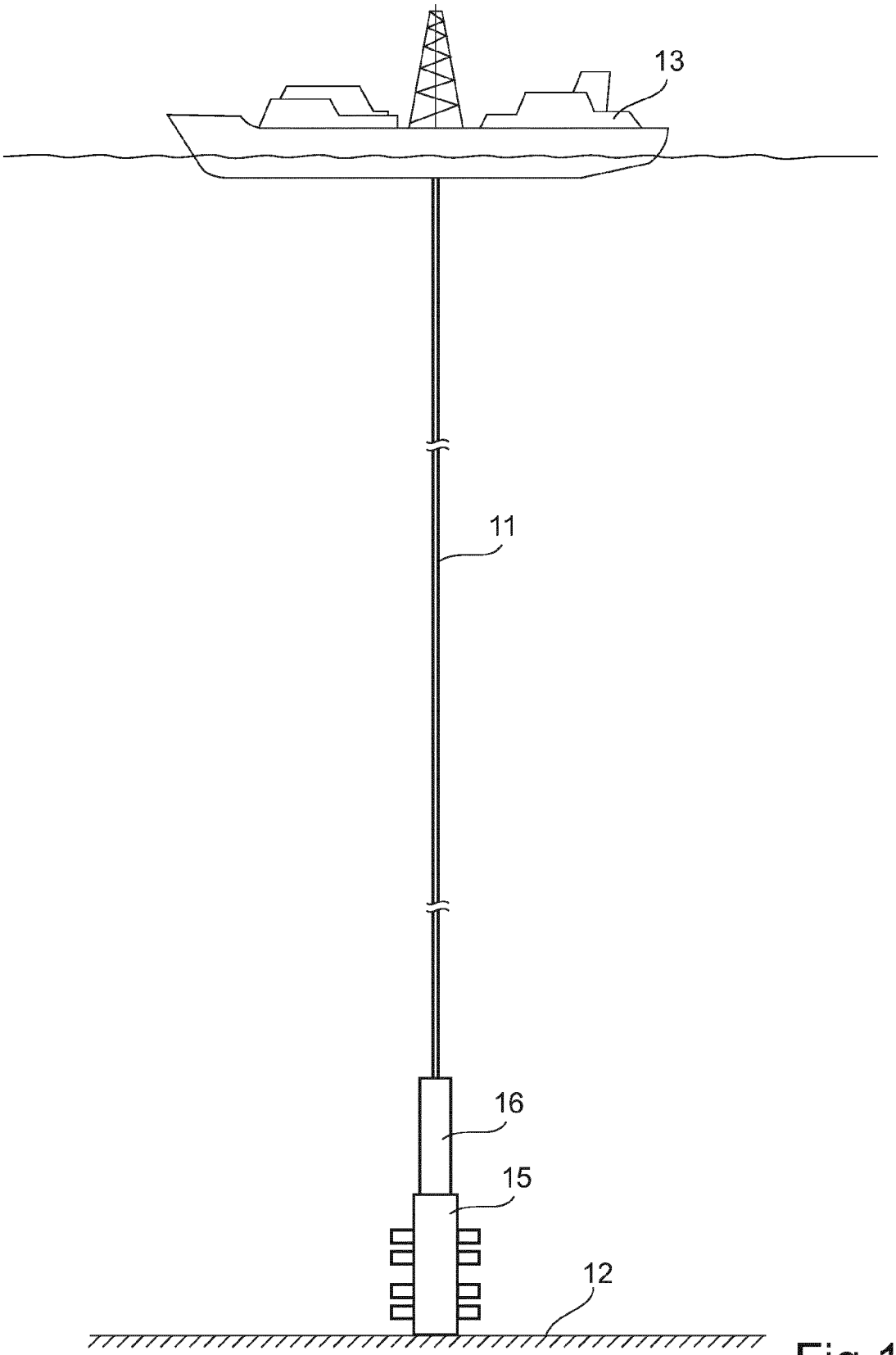
FIG. 1 shows a schematic view of a riser provided with a weak link according to the invention.

FIG. 1 shows a schematic view of a riser provided with a weak link according to the invention. A riser 11 is commonly used to link a hydrocarbon well on the seabed 12 to a floating installation or vessel 13, such as an oil rig or a ship, on the surface 14. On the seabed 12, the riser is connected to a sub sea test tree 15 via a weak link 16 according to the invention. The riser 11 is made up of lengths of tubing and is extremely heavy. The surface vessel 13 therefore needs to apply tension to the riser 11 to prevent it collapsing under its own weight. However, in certain sea conditions, for example, as the vessel moves, the applied tension will fluctuate. As the riser is fixed at its lower end to the sub sea test tree 15 on the seabed and at its upper end, by the tensioners, to a floating installation or vessel 13, it is necessary for motion of the installation caused by wind, wave and tidal action to be accommodated. Consequently, motion compensating means (FIG. 2) must be incorporated into the tensioning system to maintain the top of the riser within the moon pool of a ship or at rig floor level. The motion compensating means can include a telescopic marine joint or a drill string compensator to compensate for heaving motion while maintaining a predetermined tension to the riser and a flex joint within the riser to compensate for lateral motion of the vessel. The telescopic marine joints used are well known and are referred to herein as slip joints. A typical slip joint comprises concentric cylinders which are arranged to telescope relative to each other, with a dynamic seal provided between them.

Figure 2A:
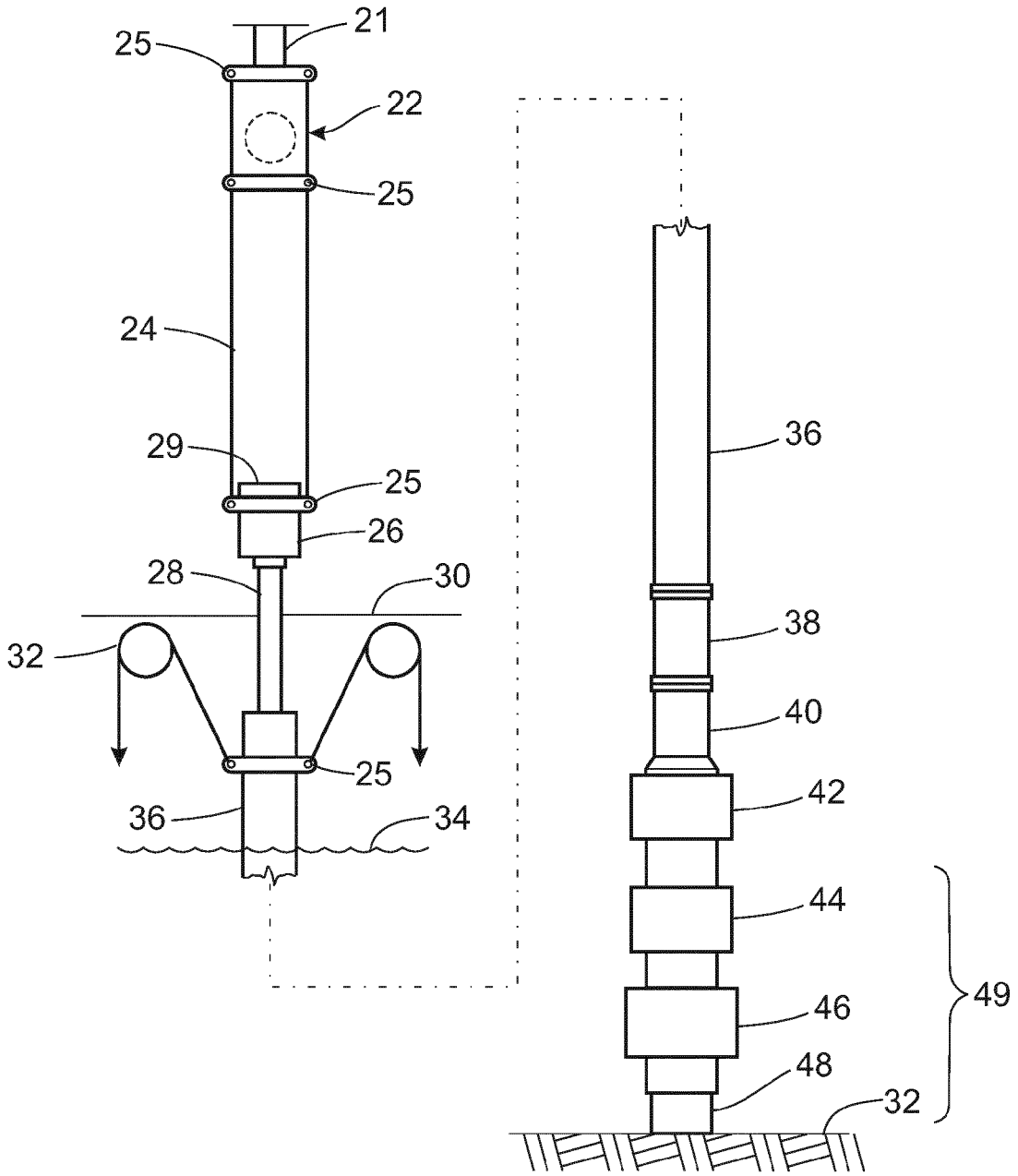
Fig.2A (Prior Art)
FIG. 2A-B show a prior art sub sea intervention set-up for a floating installation or vessel.

FIG. 2A shows a prior art sub sea intervention set-up, including a compensated hook 21, a bail winch 22, bails 24, elevators 25, a surface flow tree 26, and a coiled tubing or wire line blow-out preventer (BOP) 29, all above a drill floor 30 of a floating installation or vessel (not shown). These components are known to a skilled person and require no further explanation. Other existing components include marine riser tensioners 32, a marine riser 36 which protrudes through the sea surface 34 down through the sea to a slip joint 38, flexjoint 40 (also referred to as a flexible joint), a sub sea tree 46, and a wellhead 48, which are also known to skilled the skilled person. Components contributed by the systems and methods of the present disclosure include pressure containing tubulars 28, an emergency disconnect package (EDP) 42, and a lower riser package (LRP) 44. The lower riser package provides a hydraulic interface between the tree assembly and the EDP. The lower riser package (LRP) 44 and the sub sea tree 46 are components making up a sub sea test tree 49.

Figure 2B:
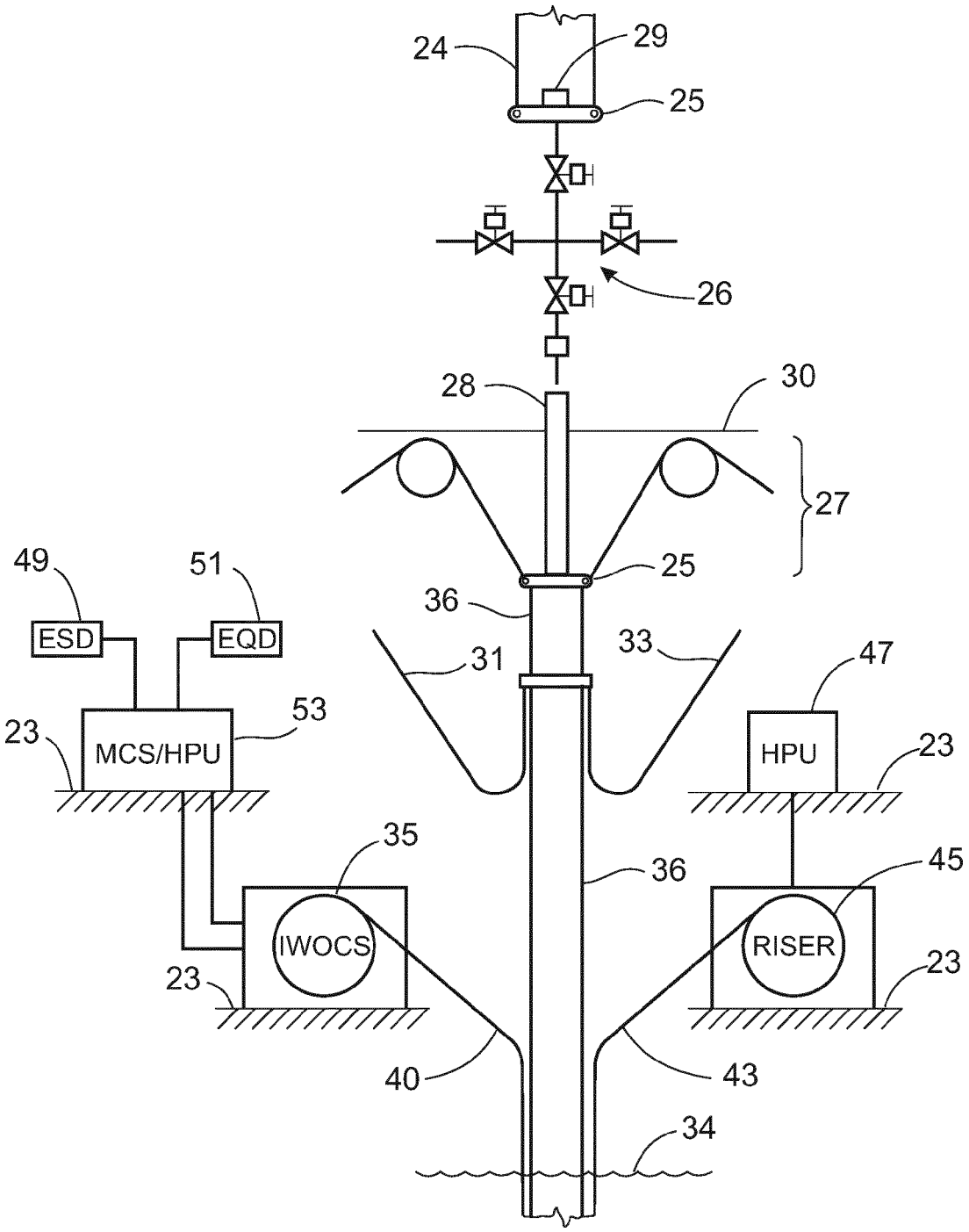
Fig.2B (Prior Art)

FIG. 2B illustrates additional details in a known set-up, such as marine riser tensioners 27, a choke line 31, a kill line 33, an installation/workover control system (IWOCS) reel 35 and IWOCS umbilical 40, an emergency shutdown (ESD) controller 49 and an emergency quick disconnect (EQD) controller 51, IWOCS master control station (MCS)/hydraulic power unit (HPU) 53, and a hydraulic line 43 and reel 45. The reels 35, 45, HPU 47 and MCS/HPU 53 may be on a deck 33 of a floating installation or vessel.

The systems referred to in here can be used in one or more operations related to well completion, flow testing, well stimulation, well workover, diagnostic well work, bullheading operations, plugging wells and/or abandoning wells where subsea trees or wellheads are installed.

A weak link according to the invention can be arranged to replace the EDP in the above example.

Figure 3:
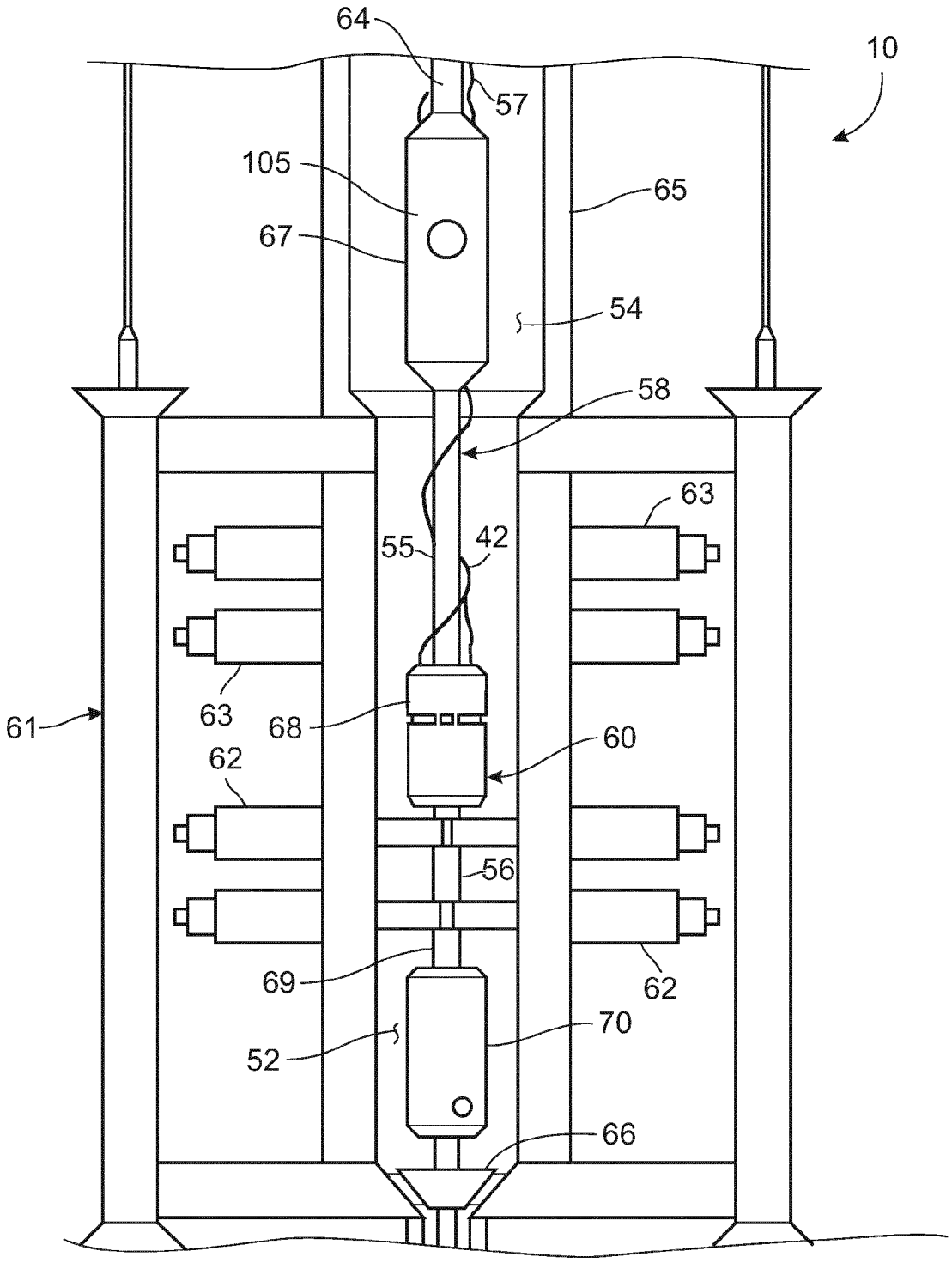
FIG. 3 show a schematic illustration of a sub sea test tree to which a weak link according to the invention is connected.

FIG. 3 shows a schematic illustration of a sub sea test tree to which a weak link according to the invention can be connected. A sub sea test tree (SSTT) 60 is positioned within a blow-out preventer (BOP) stack 61 installed on an ocean floor, or otherwise underwater. The BOP stack 61 includes two pipe rams 62 and two shear rams 63, the rams being configured around a riser 59 and controlled according to conventional practice. As representatively depicted, the BOP stack 61 is a compact BOP stack having multiple pipe and shear rams 62, 63, but it is to be clearly understood that an arrangement according to the present invention may be used for other types of BOP stacks and in BOP stacks having greater or fewer numbers of pipe and shear rams.

The sub sea test tree 60 is lowered into the BOP stack 61 through a marine riser 65 extending upwardly therefrom. A fluted wedge 66 attached below the sub sea test tree 60 permits the test tree to be accurately positioned within the BOP stack 61. A retainer valve 67 attached above the sub sea test tree 60 may remain within the marine riser 65 when the test tree is positioned within the BOP stack 61 as shown in FIG. 3. The upper part of the retainer valve 67 is to attached the riser upper section extending to the surface, directly or via a weak link or similar. The sub sea test tree 60 includes a latch head assembly 68, a ram lock assembly 69 and a valve assembly 70. The ram lock assembly 69 is interconnected axially between the latch head assembly 68 and the valve assembly 70 and axially separates one from the other. The term "ram lock assembly" is used to indicate one or more members which are configured in such a way as to permit sealing engagement with conventional pipe rams.

In FIG. 3, the ramlock assembly 69 is shown in sealing engagement with both of the pipe rams 62, the pipe rams having been previously actuated to extend inwardly and engage the ram lock assembly. The latch head assembly 68 and valve assembly 70 have diameters which are greater than that which may be sealingly engaged by conventional pipe rams, therefore, the ramlock assembly 69 provides for sealing engagement of the pipe rams 62 between the latch head and valve assemblies.

The valve assembly 70 is positioned between the pipe rams 62 and the wedge 66. Thus, when the pipe rams 62 are closed about the ramlock assembly 69, the valve assembly 70 is isolated from an annulus 54 above the pipe rams. The pipe rams 62 isolate the annulus 54 above the pipe rams from an annulus 52 below the pipe rams and surrounding the valve assembly 70.

The term "valve assembly" is used to indicate an assembly including one or more valves which are operative to selectively permit and prevent fluid flow through a flow passage formed through the valve assembly. The valves 67, 70 representatively illustrated in FIG. 3 include two safety valves, which are operative to control fluid flow through a tubular string 58. The retainer valve 67, latch head assembly 68, ram lock assembly 69 and the valve assembly 70 are all parts of the tubular string 58, which has a flow passage formed there through. The valves in the retainer valve 67 and valve assembly 70 may be actuated to permit or prevent fluid flow through the flow passage. However, it is not necessary for the retainer valve 67 or the valve assembly 70 to include multiple valves, or for the valves to comprise safety valves, within the scope of the present invention.

The term "latch head assembly" is used to indicate one or more members which permit decoupling of one portion of a tubular string from another portion thereof. For example, in the representatively illustrated SSTT 60 and the latch head assembly 68 can be actuated to decouple an upper portion 55 of the tubular string 58 from a lower portion 56 of the tubular string. Thus, in the event of an emergency, the pipe rams 62 may be closed on the ram lock assembly 69, the valves in the valve assembly 70 may be closed, and the upper portion 55 of the tubular string 58 may be retrieved, or otherwise displaced away from the lower portion 56. Closure of the pipe rams 62 on the ramlock assembly 69 and closure of the valves in the valve assembly 70 isolates the well below this point from fluid communication with the marine riser 65.

If desired, the shear rams 63 may be actuated to shear the upper portion 55 of the tubular string 58 above the latch head assembly 68. The upper portion 55 may be sheared at a tubular handling sub attached above the latch head assembly 68. For this reason, the latch head assembly 68 is positioned between the shear rams 63 and the pipe rams 62. In this manner, redundancy is preserved and safety is enhanced in that two shear rams 63 are usable above the latch head assembly 68 and two pipe rams 62 are usable below the latch head assembly in the compact BOP stack 61.

Actuation of the retainer valve 67, latch head assembly 68 and valve assembly 70 is controlled via lines 57. In the example shown in FIG. 3, the lines 57 are hydraulic lines which extend to the surface and are used for delivering pressurized fluid to the sub sea test tree 60 and retainer valve 67. However, the lines 57 could be one or more electrical lines, and the sub sea test tree 60 and/or retainer valve 67 could be electrically actuated. The lines could be replaced by one or more telemetry devices, or could extend to other locations in the well, etc., within the scope of the present invention.

A weak link according to the invention is arranged to be mounted to the riser above a sub sea test tree of the type shown in FIG. 3.

Figure 4:
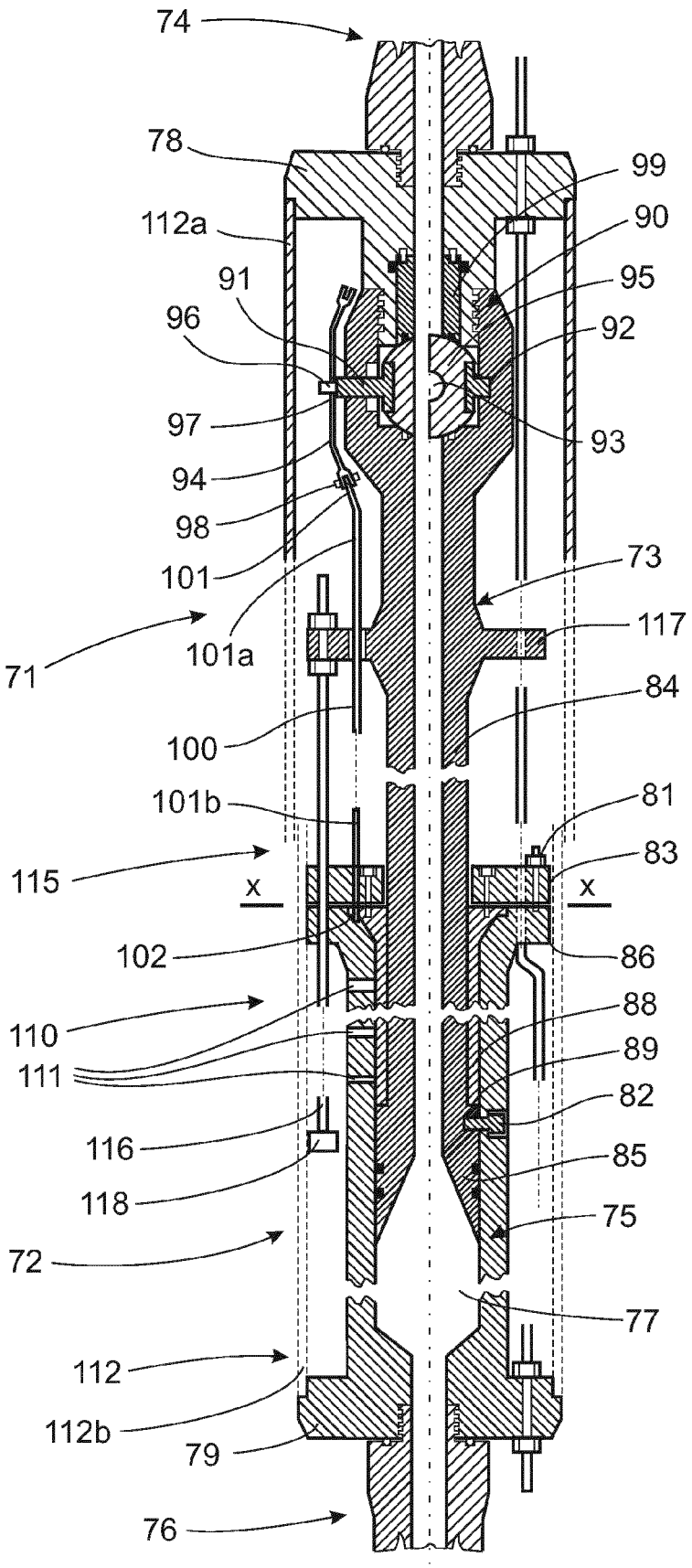
FIG. 4 shows a schematic illustration of a weak link according to the invention.

FIG. 4 shows a schematic illustration of a weak link 70 according to the invention. A weak link of the type can, for instance, be used in conventional systems for replacing an emergency disconnect package (EDP) as shown in FIG. 2A.

The weak link comprises a first riser part 71, which is the upper portion of the weak link, and a second riser part 72, which is the lower portion of the weak link. The first riser part is in the form of an upper housing 73 for connecting to a riser upper section 74, which riser extends to the surface. An upper flange 78 at the top of the upper housing 73 is provided with a standard ACME or SPO thread for connection with the riser upper section 74. The second riser part 72 is in the form of a lower housing 75 for connecting to a riser lower section 76. A lower flange 79 at the end of the lower housing 75 is provided with a standard ACME or SPO thread for connection with the riser lower section 76. The riser lower section 76 extends from the weak link 70 to the seabed and comprises a sub sea test tree (SSTT), as shown in FIG. 3. The first riser part 71 is arranged to extend into a cavity 77 in the second riser part 72, in order to allow for a telescoping displacement between the riser parts under predetermined conditions. A number of connection devices are provided for releasably connecting the upper and lower housings 73, 75.

The weak link 70 according to the example shown in FIG. 4 comprises a first connection device 81 arranged to fail if a tensile force on the first and second riser parts exceeds a first threshold force. The weak link further comprises a second connection device 82 arranged to fail if a compressive force on the first and second riser parts exceeds a second threshold force.

The first connection device comprises tension bolts 81 arranged to break in tension when the first threshold force is exceeded. Said tension bolts 81 are located in an annular flange 83 surrounding a tubular section 84 of the upper housing 73 and extend through a plane X at right angles to the main extension of the riser into an upper flange 86 at the top of the lower housing 75. This plane X separates the first and second riser parts 71, 72 and is also where the first and second riser parts will separate if the first threshold force is exceeded. The number, dimensions and material used for said tension bolts 81 is dependent on the dynamic loading and expected magnitude of the first threshold force. The tension bolts are pretensioned in order to improve the control of dynamic fatigue. Separation of the first and second riser parts 71, 72 caused by tensile forces on the tension bolts 81 will simultaneously cause the shear pins 82 to break.

The second connection device comprises shear pins 82. The first and second riser parts 71, 72 are connected by multiple shear pins 82 arranged to break in shear when the second threshold force is exceeded. Said shear pins 82 are arranged in a radial plane through the riser to connect the first and second riser parts and will shear if the second threshold force is exceeded. The shear pins 82 are arranged below the first connection device along the main axis of the weak link 70 and extend radially through the lower housing 75 and are screwed into a lower end 85 of the tubular section 84 of the upper housing 73. As opposed to the tension bolts 81, the shear pins 82 are not subjected to dynamic loads over a longer period of time. The shear pins 82 are preloaded with a predetermined load in order to allow them to withstand a certain amount of compressive force without shearing.

According to the invention, the first threshold force is larger than the second threshold force. The relationship between the first and second threshold forces is dependent on the type of installation, the length and dimensions of the riser, etc. For example, the first threshold force can be selected to release the weak link at a load of 250 metric tonnes in tension, while the second threshold force can be selected to release the weak link at a load of 35 metric tonnes in compression. The arrangement according to the invention provides an asymmetry between compressive forces and tensile forces acting on the riser and the weak link.

When the weak link is assembled, the upper and lower housings 73, 75 are held together by the tension bolts 81. The tension bolts 81 clamp together the annular flange 83 surrounding the tubular section 84 of the upper housing 73 and the flange 86 at the top of the lower housing 75. In order to maintain the upper and lower housings 73, 75 in a fixed datum position, a split bearing 88 is located around the tubular section 84 extending into the lower housing 75. The split bearing 88 is located in a cylindrical space between the tubular section 84 extending into the lower housing 75. The split bearing 88 is attached to the lower surface of the annular flange 83 and rests against an annular surface 89 extending radially outwards from the tubular section 84. Consequently, only the outer periphery of the lower end 85 of the tubular section 84 is in contact with the inner surface of the cavity 77 in the lower housing. The lower end 85 of the tubular section 84 is provided with circumferential seals to prevent fluid from leaking upwards past said lower end 85. The lower end 85 of the tubular section 84 has a fluid conduit with a generally conical cross-section that opens up downwards. This shape reduces the fluid resistance of said lower end 85 when the tubular section 84 moves into the cavity 77.

A tensile force applied to the upper housing 73 by the riser will be transferred to the split bearing 88 by the annular surface 89 on the tubular section 84. The force will the be transferred to the annular flange 83, which is in turn attached to the lower housing 75 by the tension bolts 81. Should the tensile force exceed said first threshold force, then the tension bolts 81 will break.

Should a compressive force be applied to the upper housing 73 by the riser, then this force will be applied directly to the shear pins 82. The tubular section 84 of the upper housing 73 is slidable relative to the annular flange 83 surrounding said tubular section 84. Hence, as soon as the compressive force exceeds the combined pre-tension of the shear pins 82 and the second threshold force, the shear pins 82 will shear.

After separation the first and second riser parts 71, 72 are arranged to telescope with respect to each other, wherein the tubular section 84 of the upper housing 73 is arranged to telescope upwards, partially out of the cavity 77 in the lower housing 75, following the failure of said tension bolts 81. Similarly, the tubular section 84 of the upper housing 73 is arranged to telescope downwards, into the cavity 77 in the lower housing 75, following the failure of said shear pins 82. The direction is dependent on which connection device fails first. The first and second riser parts 71, 72 are arranged to telescope with respect to each other up to a maximum predetermined distance in the first or the second direction, from the initial datum or mid-point position. The total distance between the upper and the lower end points of the telescoping motion is termed the stroke of the weak link. The maximum predetermined distance is substantially equal in both directions and is dependent on the allowable motion of a motion compensation means on the floating installation or vessel. If the heave of the floating installation or vessel exceeds a maximum allowable stroke prior to separation of the weak link, then the weak link is disconnected from the sub sea test tree to avoid damage to the sub sea structure. In the current example, the allowable motion of a motion compensation means is approximately 4.5-5 meters up and down, the maximum predetermined distance is 4 meters in each direction. Hence, if the stroke exceeds 8 meters, the weak link will be disconnected. If the maximum predetermined distance is exceeded before the weak link will can be disconnected, then either or both of the first and second connection devices will fail and release the weak link.

The weak link in FIG. 4 is not drawn to scale. Certain component parts have a predetermined length y indicated in FIG. 4, which length y in this case is 4 meters. However, these parts have been compressed in length, as indicated by broken lines, to allow the weak link to be shown more clearly.

An upper sealing means in the form of a schematically indicated ball valve 90 is located in the first riser part 71 and is arranged to close the riser upper section 74. The ball valve 90 is actuated after separation of the first connection device, when the first threshold force is exceeded and the first riser part 71 telescopes upwards, away from the second riser part 72. Should the second threshold force be exceeded first, so that the first riser part 71 telescopes downwards, into the second riser part 72, then closure of the ball valve 90 is not actuated. Closure of the ball valve 90 prevents hydrocarbons from flowing downwards and out of the riser upper section 74 into the surrounding sea or a marine riser (not shown).

The ball valve 90 is actuated by an actuator 94 displaced by the relative motion of the first and second riser parts 71, 72, as the riser and the first riser part is lifted upwards. The ball valve 90 has a spherical valve body 95 journalled at a first and a second end 91, 92 and is rotated about an axis at right angles to the main extension of the riser. The spherical valve body has a central cylindrical bore 93 for fluid flow from the well. In FIG. 4, the left hand side of the ball valve 90 is shown in its open position and the right hand side of the ball valve 90 is shown rotated 90° into its closed position. The spherical valve body 95 of the ball valve 90 is held in position by means of an energized seal 99. This is a standard component comprising an annular body having a first O-ring arranged in a lower surface that seals against the upper surface of the spherical valve body 95. A second O-ring is arranged around the upper circumference of the annular body to seal against a recess in the lower portion of the upper flange 78. The annular body is pressed against the spherical valve body by springs arranged between the upper surface of the annular body and the recess in the upper flange 78. When the ball valve 90 is open, the energized seal 99 is held in sealing contact with the spherical valve body 95 by means of said springs and pressurized fluid in the gap between the upper surface of the annular body and the recess in the upper flange. This pressure is acting on the upper surface of the spherical valve body. When the ball valve 90 is closed (indicated on the right hand side of FIG. 4) then well pressure acting on the ball valve 90 will attempt to lift the spherical valve body 95 off a seal comprising an O-ring is arranged between the lower surface of the spherical valve body and a recess in the upper housing 73. This lifting force is counteracted by the springs of the energized seal 99 and pressure from the fluid in the riser extending to the surface.

The valve actuator 94 comprises a control arm connected to the valve body 95 at its first end 91. A first end 97 of the control arm 94 is connected to the valve body 95 by a one-way mechanism in the form of a one-way ratchet 96. The one-way mechanism 96 ensures that the valve body 95 is actuated to close the ball valve 90 only after separation of the first connection device 81, when the first threshold force has been exceeded. The other end 98 of the control arm 94 is connected to the second riser part via a control rod 100. The control rod 100 has a predetermined initial length and is connected to the control arm at its first end 101 and is supported by and attached to the flange 86 at the top of the lower housing 75 of the second riser part 72. The control rod 100 will compress lengthwise in its longitudinal direction if the second threshold force be exceeded first, whereby that the first riser part telescopes downwards into the second riser part. This is achieved by forming a first portion 101*a* of the control rod out of a hollow profiled section or a tubular section (not shown). A second portion 101*b* of the control rod 100 comprises a solid or hollow section having a cross-section that can be telescoped into said first portion 101*a*. As the first and second portions 101*a*, 101*b* of the control rod 100 telescope in the longitudinal direction, the ball valve 90 is not actuated after separation of the shear pins 82.

When the first threshold force is exceeded, the control rod 100 will not extend from its predetermined initial length. Instead the control rod 100 will act on the control arm 94 as the first and second riser parts 71, 72 telescope away from each other. The control arm 94 is arranged to actuate the ball valve 90 by rotating the valve body 95 through 90° to close the ball valve 90. Once the ball valve 90 has been closed, further action applied to the control arm 94 will cause the connection between the control arm 94 and the valve body 95 to become inoperative. In this example, this is achieved by a shear pin (not shown) in the connection between the control arm 94 and the valve body 95. When the valve body 95 has been rotated through 90° to a stop, additional force applied to the control arm 94 will sever the shear pin and release the connection between the control arm 94 and the valve body 95.

When actuated, the ball valve 90 will close and at the same time physically cut and seal off equipment such as a wire line or coiled tubing (not shown) above the separation point.

The retainer valve 67, shown in FIG. 3, comprises a lower ball valve 105 located in upper portion of the SSTT fixed to the seabed, which in turn is located below the lower portion of a weak link according to the invention that is screwed into the SSTT. The lower ball valve 105 in the SSTT will close a predetermined period of time after the upper ball valve 90 in the weak link to eliminate the end cap pressure acting on the weak link and to prevent additional HC from leaking out of the well. The reason for the delay in closing is that the upper ball valve is actuated mechanically by the control arm 94, while the lower ball valve in the SSTT is actuated hydraulically and may have a reaction time of up to, for instance, 30 s.

According to one example, the SSTT can be provided with at least two valves, which are hydraulically controlled from the surface via control lines. In addition, a fail-safe function is built into the system in case of a weak link separation. The weak link provides by-pass hydraulic lines for closing the lower ball valve 105. The SSTT valve can close with sufficient force to cut control lines (wire lines) extending into the well.

After release, the hydraulic control lines for maintaining communication with the SSTT, in particular with the SSTT latch, must be able to extend to compensate for the stroke of the weak link from the datum line to maximum extension. The hydraulic control lines comprise a folded or coiled bundle of lines (not shown) which bundle is arranged to extend and to be controllably folded or coiled to its original position with the motion of the weak link parts. The hydraulic control lines remain in operation even after the SSTT closes after a fail safe operation. The control lines can also be used for release of the SSTT latch to disconnect the riser for pull-up and weak link repair.

When the upper ball valve 90 in the weak link closes, hydrocarbons (HC) are prevented from flowing down through the riser after separation to cause an HC spill. Closing of the upper ball valve 90 causes a jetting effect on the weak link referred to as end cap pressure by the skilled person. As the surface tree and the riser may have a combined weight of 40-50 tonnes, the end cap pressure could lift the entire assembly if not controlled. According to the invention, HC under pressure will be ventilated from the weak link before maximum upwards stroke is reached, until the lower ball valve 105 in the SSTT closes.

In order to release the end cap pressure after separation but before the lower ball valve closure, and to ensure that any remaining enclosed pressure is vented before the upper weak link portion reaches its maximum extension upwards and begins to move downwards, a pressure release means 110 is actuated. As described above, the first riser part 71 has a tubular section 84 with a lower end 85 extending down into the second riser part 72. A major portion of the first riser part extending into the second riser part is surrounded by a static packing 88 in the form of a split bearing. The split bearing 88 is attached to the lower surface of the annular flange 83 of the first riser part 71 and rests against an annular surface 89 extending radially outwards from the tubular section 84. The axial length of the static packing is substantially the same as the maximum distance between the upper end point of the telescoping motion and the initial datum or mid-point position.

The outer periphery of the lower end 85 of the tubular section 84 is in contact with the inner surface of the cavity 77 in the lower housing. The lower end 85 of the tubular section 84 is provided with circumferential seals to prevent fluid from leaking upwards past said lower end 85.

The split bearing 88 is arranged to be displaced upwards with the first riser part 71 of the weak link upon separation of the tension bolts 81. Displacement of the split bearing 88 and the lower end 85 of the tubular section 84 will expose the pressure release means 110 comprising a number of radial vent holes 111 through the wall of the lower housing 75. As indicated in FIG. 4, vent holes 111 of gradually increasing diameter will be exposed in sequence over the length of the stroke as the split bearing 88 and the lower end 85 of the tubular section 84 moves upwards. Initial, relatively smaller holes will begin to release the relatively high enclosed pressure at a rate that will not damage or burst a surrounding structure, such as a surrounding stabilizer 112 or a marine riser (not shown). Continued upwards motion will cause gradual, controlled release of pressurized HC into the marine riser. The size and/or number of holes is determined by a number of factors, such as the well pressure and ambient pressure (depth below sea level). The stabilizer 112 schematically indicated in FIG. 4 comprises a first and a second cylindrical tube 112*a*, 112*b* extending between the upper flange 78 of the first riser part 71 and the lower flange 79 of the second riser part 72. Said first and second cylindrical tubes 112*a*, 112*b* are arranged to telescope relative to each other following a release of the first and second connection devices 81, 82.

Figure 6:
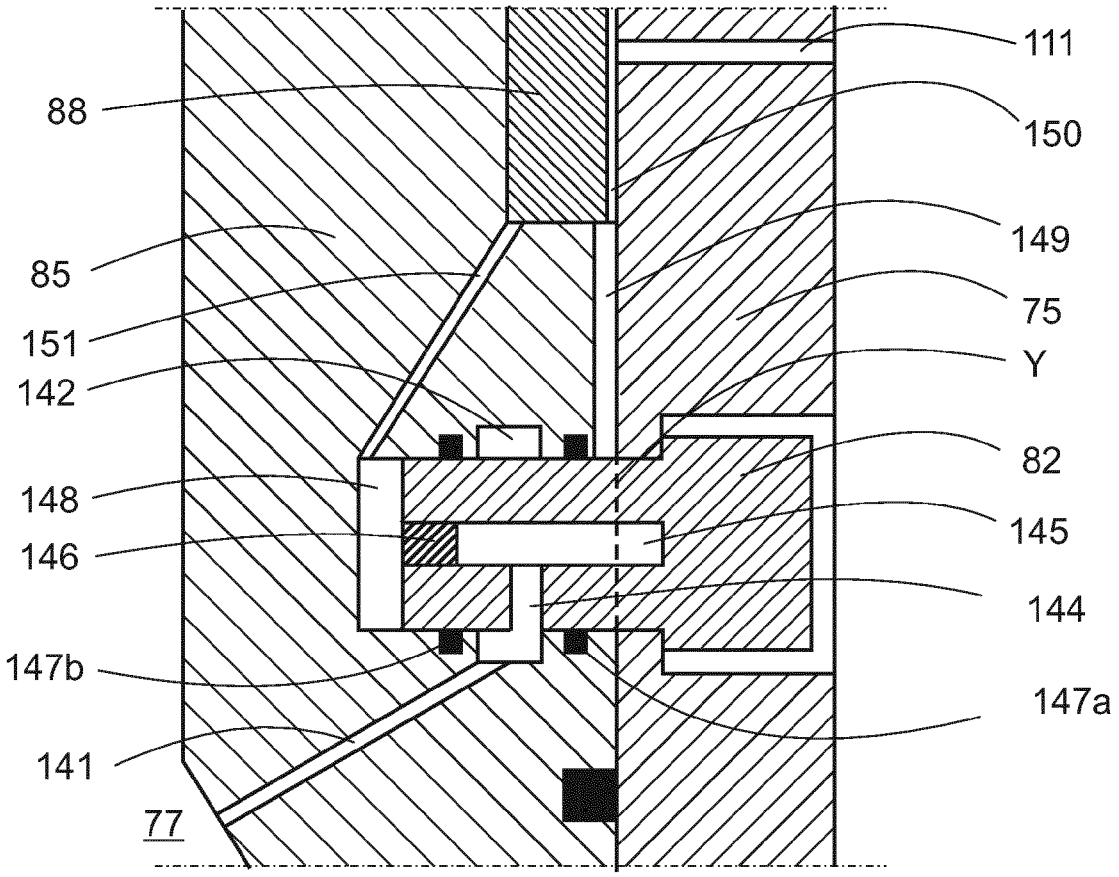
FIG. 6 shows an enlarged view of a shear pin in FIG. 5.

The lower end 85 of the tubular section 84 is provided with an additional pressure release means, shown in FIG. 6, which is actuated when the shear bolts 82 have sheared. The additional pressure release means is used for venting pressure from the cavity 77 after closure of at least the upper ball valve 90. As stated above, the tubular section 84 of the upper housing is arranged to telescope downwards, into the cavity 77 in the lower housing 75, following the failure of said shear pins 82. The pressure in the cavity 77 is initially vented through the vent holes 111, as the lower end 85 of the tubular section 84 moves downwards. Once the leading end of said lower end 85 of the tubular section 84 passes the lowermost of the holes 111, the additional pressure release means maintains the venting function.

Fluid under pressure will flow from the cavity 77 into a first conduit 141 in said lower end 85 towards an annular groove 142 surrounding the inner end 143 of the shear pin 82. One or more radial holes 144 in the shear pin 82 connect the annular groove 142 with a central bore 145. The bore 145 is closed by a plug 146 screwed into said bore at the inner end 143 of the shear pin 82. Before separation the first and second riser parts 71, 72 of the weak link (FIG. 4) pressure from the cavity 77 will only reach the bore 145. Fluid is prevented from leaking from the annular cavity 142 between the lower end 85 and the shear pin 82 towards the outer end of the shear pin by means of a first O-ring 147*a* or a similar suitable seal surrounding the shear pin 82. Similarly, fluid is prevented from leaking from the annular cavity 142 towards a cavity 148 in which the inner end of the shear pin 82 is located by means of a second O-ring 147*b*. The cavity 148 containing the inner end of the shear pin 82 is vented to ambient pressure through a conduit 151 extending into the space containing the split bearing 88. Optionally, this conduit can contain a non-return valve preventing fluid flow towards the cavity 148, in order to ensure that a sheared-off end of the shear pin is retained at the inner end of the cavity 148.

After separation the first and second riser parts and when the shear pin 82 has sheared along a plane Y pressure from the cavity 77 will reach the bore 145 and act on the sheared-off end of the shear pin 82. The sheared-off end of the shear pin 82 will be displaced towards the inner end of the cavity 148 in which the shear pin 82 is located, and is retained in this position by the fluid pressure and the friction of the O-rings 147*a*, 147*b*. The axial extension of the annular cavity 142 corresponds to the displaced distance of the shear pin 82, in order to maintain the connection between said annular cavity 142 and the one or more radial holes 144. Fluid is then allowed to flow from the cavity 77, into the central bore 145 and out through the gap (not shown) opened up between the sheared portions of the shear pin 82. Subsequently, fluid flows upwards through a machined slot 149 in the outer surface of the lower end 85 of the tubular section 84. The machined slot 149 extends from the shear pin 82 to the lower surface of the split bearing 88. The fluid can then escape through the radial vent holes 111 through the wall of the lower housing 75, via a radial gap 150 between the split bearing 88 and the lower housing 75.

The venting of the cavity 77 can be achieved by alternative means such as pressure controlled valves, throttle valves or burst discs, which can be arranged to burst and release pressure towards the vent holes 111 when the pressure in the cavity exceeds a predetermined value.

A retaining device 115 is arranged to suspend the second riser part 72 below the first riser part 71 following the release of the first and second connection devices 81, 82. The retaining device can comprise two or more rods 116 (one shown) attached to the first riser part 71 at an intermediate flange 117, located between the upper flange 78 and the annular flange 83 surrounding the tubular section 84. The second riser part 72 is displaceable relative to the retaining device 115 during the telescoping movement following a separation of the weak link. Consequently, said rods 116 pass through coinciding holes in the annular flange 83 and the upper flange 86 of the second riser part 72.

Following a release of the first and second connection devices 81, 82 the first and second riser parts 71, 72 are allowed to telescope relative to each other without being impeded by the retaining device 115, which has a length allowing for movement in excess of the stroke of the weak link. After a separation of the weak link, a controlled unlatching of the weak link from the SSTT is initiated. Once the weak link is unlatched, second riser part 72 will slide down along the rods 116 and be caught by and supported on recovery pins 118 at the end of each rod 116. The riser and the first and second riser parts 71, 72 can then be brought to the surface for repairs.

Should the riser be subjected to excessive tension after a separation, but before the weak link has been unlatched from the SSTT, the recovery pins 118 at the end of each rod 116 of the retaining device 115 will break and release the second riser part 72. The riser and the first riser part 71 can then be salvaged. The force required to break the recovery pins 118 is preferably larger than the first threshold force.

Figure 5:
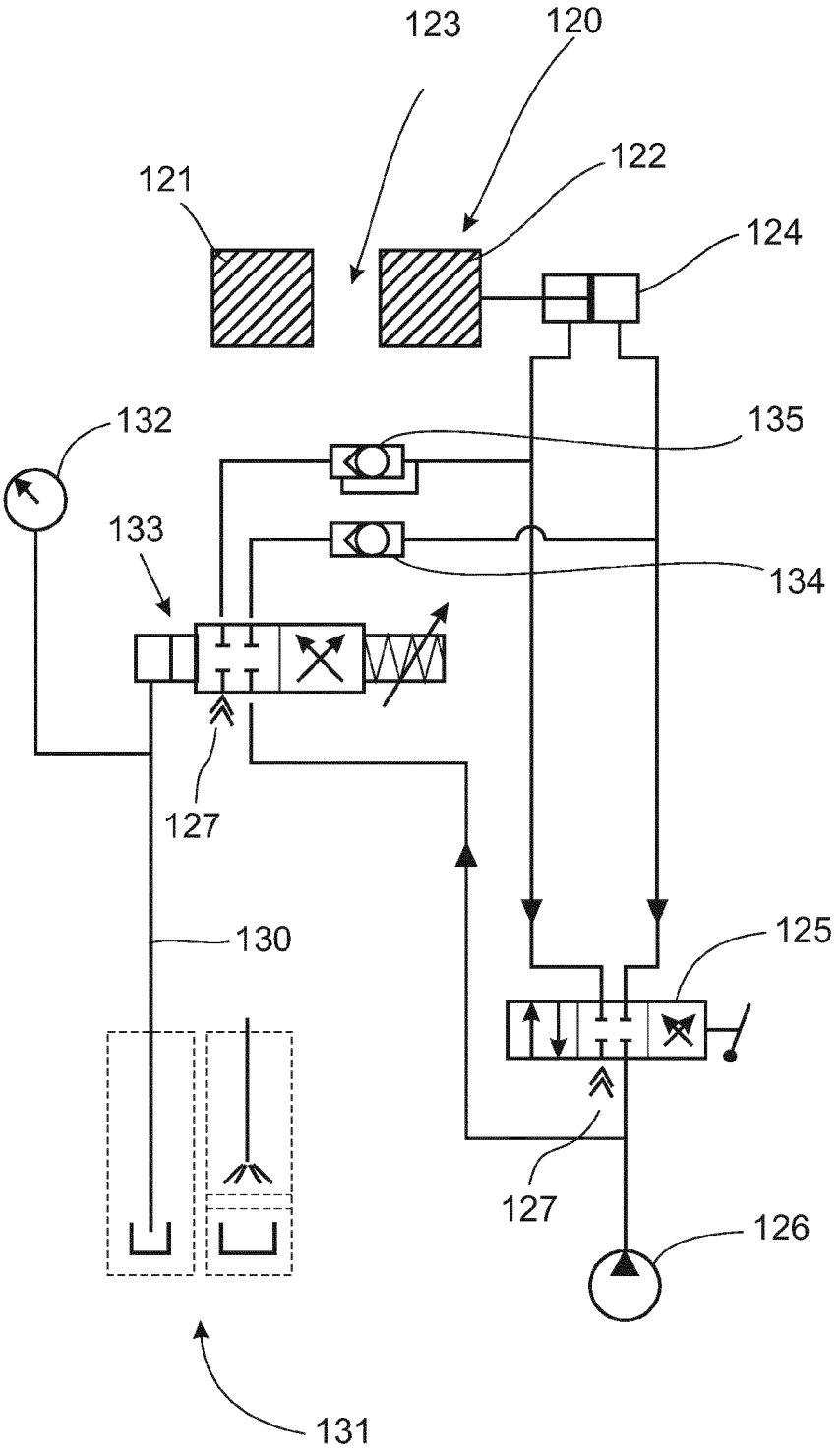
FIG. 5 shows a schematic hydraulic circuit for a diverter controlled by a weak link according to the invention.

FIG. 5 shows a schematic hydraulic circuit for a diverter controlled by a weak link according to the invention.

A flow diverter 120, or simply "diverter", is used for directing pressurized well bore fluid away from a fluid system on-board a surface installation to prevent danger to equipment and personnel. The diverter 120 is placed in-line with the marine riser (not shown). The diverter 120 comprises a housing with an annular packing element 121 and a piston 122, wherein passages 123 are provided in the piston 122 and the housing walls to allow fluid communication between the borehole and outlets in the housing wall. The piston 122 is controlled by a fluid operated cylinder 124.

A vent line is provided to transport pressurized (drilling) fluid away from the surface installation when borehole fluid of excess pressure is present and the annular packing element is closed. A valve in the vent line (not shown) is closed during normal drilling operations, but opens simultaneously with the closing of the annular packing element in the diverter. On an offshore drilling rig the vent line directs the pressurized fluid overboard, until the flow can be shut down safely. Such arrangements are well known in the art and will not be described here.

The fluid operated cylinder 124 can be controlled by means of a three way valve 125 operated manually or automatically from a main panel on the floating installation. The three way valve 125 is normally closed, but can be actuated into a first position where fluid is supplied from a pressure source 126 to the cylinder 124 to close the annular packing element in the diverter 120. The pressure source 126 is preferably a source of high pressure supplying a pressure of 1500 psi. The three way valve 125 can be actuated into a second position where the cylinder 124 is connected to a drain 127 to close the diverter 120.

The fluid operated cylinder 124 can also be controlled by a fluid connection 130 from the weak link 131. When the weak link 131 is operating normally, the fluid connection 130 is pressurized by a pilot pressure from a low pressure source 132. This pressure is sufficient to maintain a two-way valve 133 in a closed position against a spring load, wherein flow through the valve is prevented.

Should the weak link 131 separate then the fluid connection 130 will be vented and the two-way valve 133 will move into an open position by the spring load. Fluid is then supplied from the pressure source 126 to the cylinder 124 to close the diverter 120. A first non-return valve 134 is located between the two-way valve 133 and the cylinder 124 to prevent high pressure fluid from flowing towards the two-way valve 133 when the three-way valve is actuated to close the diverter 120. A second non-return valve 135 is located between the two-way valve 133 and the cylinder 124 to prevent high pressure fluid from flowing towards the two-way valve 133 when the three-way valve is actuated to open the diverter 120. The second non-return valve 135 is provided with a throttled by-pass conduit to allow return fluid from the cylinder 124 to return to the drain 127 during closing of the diverter 120.

The invention is not limited to the above embodiments, but may be varied freely within the scope of the appended claims. The riser and weak link according to the invention can be used as a workover riser installed above a lower landing string assembly. Workover risers usually do not have weak links, because they bypass the blow-out preventer. The weak link is provided with suitable standard connectors, such as API (American Petroleum Institute) or SPO (Steelproducts Offshore), for attachment to existing conventional equipment can be used for installations with or without a marine riser.

The invention claimed is:

1. A riser weak link in a riser connecting a floating installation or vessel to a hydrocarbon well on the seabed, said weak link comprising a first riser part in the form of an upper housing for connecting to a riser upper section;

a second riser part in the form of a lower housing for connecting to a riser lower section, wherein one riser part is arranged to extend into the other riser part; and connection devices for releasably connecting the upper and lower housings, wherein the weak link comprises a first connection device arranged to fail if a tensile force on the first and second riser parts exceeds a first threshold force, and wherein the weak link comprises a second connection device arranged to fail if a compressive force on the first and second riser parts exceeds a second threshold force.

2. A riser weak link according to claim 1, wherein the first threshold force is larger than the second threshold force.

3. A riser weak link according to claim 1, wherein the first and second parts are arranged to telescope with respect to each other, wherein the first and second parts are arranged to telescope in a first direction following the failure of said first connection device, and/or to telescope in a second direction following the failure of said second connection device.

4. A riser weak link according to claim 3, wherein the first and second parts are arranged to telescope with respect to each other up to a maximum predetermined distance in the first or the second direction, from an initial datum position.

5. A riser weak link according to claim 1, wherein said first connection device comprises at least two shear bolts.

6. A riser weak link according to claim 5, wherein said first connection device is located in an annular section surrounding the riser and extends through a plane at right angles to the main extension of the riser.

7. A riser weak link according to claim 1, wherein said second connection device comprises at least two shear pins.

8. A riser weak link according to claim 6, wherein said second connection device is arranged in a radial plane through the riser to connect the first and second riser parts.

9. A riser weak link according to claim 6, wherein a valve located in first riser part is arranged to close the riser upper section, which valve is actuated when the first threshold force is exceeded.

10. A riser weak link according to claim 9, wherein the valve is actuated by an actuator displaced by the relative motion of the first and second parts.

11. A riser weak link according to claim 1, wherein a retaining device is arranged to suspend the second riser part below the first riser part following the release of the first and second connection devices.

12. A riser string extending from a floating installation or vessel to a hydrocarbon well on the seabed, said riser string comprising a motion compensating means, multiple riser pipe sections supported by the motion compensating means, a sub sea test tree located on the seabed, wherein a lower section of the riser and the sub sea test tree are connected by a weak link according to claim 1.

* * * * *